US011890498B2

(12) United States Patent
Struve et al.

(10) Patent No.: US 11,890,498 B2
(45) Date of Patent: Feb. 6, 2024

(54) BRACKET ASSEMBLY FOR AN EXERCISE APPARATUS AND THE LIKE

(71) Applicant: S&G UNLIMITED, LLC, Bee Cave, TX (US)

(72) Inventors: Matthew Struve, Bee Cave, TX (US); Michael Gulla, Bee Cave, TX (US)

(73) Assignee: S&GUNLIMITED, LLC, Bee Cave, TX (US)

( * ) Notice: Subject to any disclaimer, the term of this patent is extended or adjusted under 35 U.S.C. 154(b) by 0 days.

(21) Appl. No.: 17/687,973

(22) Filed: Mar. 7, 2022

(65) Prior Publication Data

US 2022/0355154 A1 Nov. 10, 2022

Related U.S. Application Data

(60) Provisional application No. 63/186,516, filed on May 10, 2021.

(51) Int. Cl.
*A63B 21/078* (2006.01)
*A63B 21/072* (2006.01)

(52) U.S. Cl.
CPC ..... *A63B 21/0783* (2015.10); *A63B 21/0724* (2013.01); *A63B 2225/093* (2013.01)

(58) Field of Classification Search
CPC ... A63B 21/06; A63B 21/072; A63B 21/0724; A63B 21/0728; A63B 21/078; A63B 21/0783; A63B 21/08
See application file for complete search history.

(56) References Cited

U.S. PATENT DOCUMENTS

| | | | | |
|---|---|---|---|---|
| D322,361 | S * | 12/1991 | Goodman | D8/367 |
| 5,162,031 | A * | 11/1992 | Watson | A63B 21/0626 482/104 |
| 5,779,602 | A * | 7/1998 | Rodriguez | A63B 21/078 482/104 |
| 6,371,893 | B1 | 4/2002 | Redden | |
| 7,338,416 | B2 | 3/2008 | Smith | |
| 10,086,226 | B2 * | 10/2018 | Nelson | A63B 21/4035 |

(Continued)

OTHER PUBLICATIONS

International Search Report and Written Opinion dated Jun. 8, 2022 for corresponding PCT Application No. PCTUS2022019653 (10 pages).

*Primary Examiner* — Zachary T Moore
(74) *Attorney, Agent, or Firm* — Chamberlain, Hrdlicka, White, Williams & Aughtry; Aly Z. Dossa

(57) ABSTRACT

A bracket assembly for an exercise apparatus is disclosed. The bracket assembly includes a plate member having a U-shaped chamber. The plate member includes a gusset extending from an outer side of the plate member. The plate member further includes a pin extending from the outer side of the plate member. The gusset receives a rack of an exercise apparatus. The pin inserts in one of a plurality of rack openings and connects the bracket assembly to the rack. A user places a barbell in the plate member through the U-shaped chamber. The U-shaped chamber allows the user to have a safe and controlled upward and downward motion for performing exercises with the barbell while in a seated or standing position. The U-shaped chamber acts as a holder for the barbell and prevents the user from tipping over or losing balance holding the barbell in the chamber.

20 Claims, 7 Drawing Sheets

(56) References Cited

U.S. PATENT DOCUMENTS

| | | | | |
|---|---|---|---|---|
| 11,241,602 | B2 * | 2/2022 | Grissel, Jr. | A63B 21/078 |
| 2006/0035765 | A1 * | 2/2006 | Smith | A63B 21/078 482/97 |
| 2015/0087485 | A1 * | 3/2015 | Kimura | A63B 17/00 482/104 |
| 2017/0246496 | A1 * | 8/2017 | Nelson | A63B 21/0724 |
| 2018/0280782 | A1 * | 10/2018 | Lagree | A63B 71/0619 |
| 2019/0247701 | A1 * | 8/2019 | Sergakis | A63B 71/0036 |
| 2020/0114191 | A1 * | 4/2020 | Chen | A63B 71/0036 |
| 2020/0261759 | A1 * | 8/2020 | Downing | A63B 71/0036 |
| 2020/0353303 | A1 | 11/2020 | Hammond | |
| 2020/0384337 | A1 | 12/2020 | Brasch et al. | |

* cited by examiner

BRACKET ASSEMBLY FOR AN EXERCISE APPARATUS AND THE LIKE

RELATED APPLICATIONS AND CLAIM FOR PRIORITY

The present application claims priority from U.S. Provisional Patent Application No. 63/186,516, filed May 10, 2021 with title "BRACKET ASSEMBLY FOR AN EXERCISE APPARATUS AND THE LIKE" which is incorporated herein by its entirety and referenced thereto.

FIELD OF INVENTION

The present invention generally relates to an accessory for use with an exercise apparatus. More specifically, the present invention relates to a bracket assembly for use with an exercise apparatus. The bracket assembly enables a user to perform different body building and physical fitness exercises.

BACKGROUND OF INVENTION

Exercise apparatuses include, but not limited to, racks, rigs, cages, stands and the like. Exercise apparatuses enable a user to perform various exercises using weights, barbells, dumbbells, pull-up bars, dip stations, self-spotting bars, cables, ropes, elastic bands, and the like. Exercise apparatuses require accessories such as brackets to support the weight of the barbells and the like to the beams of a rack. The brackets allow the barbells to position at different locations on the beams such that individuals can perform different exercises.

Several accessories such as brackets used for supporting weight of the barbells and the like have been disclosed in the past. One such example is disclosed in a United States Publication No. 20190247701, entitled, "Assembly for Weightlifting Racks" ("the '701 Publication"). The '701 Publication discloses a bracket assembly having a back plate with outer and inner sides and a pin opening extending therethrough. A clasp member has an extending portion and an encasing portion extending from the extending portion. The extending and encasing portions and the inner side of the body define a chamber configured to receive a rack beam. A pin seated in the pin opening has a shank, and a head at the outer side of the back plate. The shank extends through the opening into the chamber. The shank is configured to engage the rack beam within the chamber. The head is welded to the outer side of the back plate. An extension member defines a support surface and includes a pair of substantially J-shaped plates and a cover nested with the plates such that it forms the entire support surface and is substantially flush with sides of the substantially J-shaped plates.

Another example is disclosed in a U.S. Pat. No. 6,371,893, entitled "Body Supported Barbell Carrying Device" ("the '893 Patent"). The '893 Patent discloses a body supported carrying device for increasing the comfort for the weightlifter. The body supported carrying device includes a pair of body supported carrying members each of which includes a base member which is an inverted U-shaped structure and which has an inner side and a pair of spaced extended portions, and which further includes a padded member securely attached to the inner side between the extended portions, and which also includes a weight-lifting bar support member which includes a stub shaft which is pivotally mounted in a top of the base member and which has a longitudinal slot extending through a second end of the stub shaft. The slot is adapted to receive a portion of a weight-lifting bar and the extended portions of the U-shaped structure is adapted to fit about a user's legs and shoulders.

Another example is disclosed in a U.S. Pat. No. 7,338,416, entitled "Bar Supports for a Weight Bench" ("the '416 Patent"). The '416 Patent discloses a bar support member that can be used to hold a weight bar in a desired position on a piece of exercise equipment. Additionally, embodiments of the present invention can be used to provide a safety stop or spotter for supporting the weight bar in the event that the user cannot return the weight bar to its original bar support member.

Although the above-discussed disclosures provide brackets used for supporting weight of the barbells and the like, they have few problems. For example, the J-cup bracket disclosed in the '701 Publication includes an angled outer lip. A user using the barbell may accidentally place the barbell at the edge of the angled outer lip and drop the barbell with weights on his body resulting in an injury to him.

Therefore, there is a need for an improved bracket assembly having a U-shaped plate for holding a barbell and the like firmly to an exercise apparatus and preventing the barbell from slipping and injuring the user.

SUMMARY

It is an object of the present invention to provide a bracket assembly having a U-shaped plate for holding a barbell and the like firmly to an exercise apparatus and that avoids the drawback of known brackets.

It is another object of the present invention to provide a bracket assembly that keeps a user safe while lifting a barbell upward from a weight storage apparatus, by preventing them from tipping over backward or from losing balance in general by containing the barbell in a chamber (U-shaped plate member), allowing total focus on managing the exercise movements, and less about balance.

It is another object of the present invention to provide a bracket assembly having a unique u-shaped chamber configured to provide stability to a bar or barbell in a vertical lifting motion while performing exercises.

In order to achieve one or more objects, the present invention provides a bracket assembly for an exercise apparatus. The bracket assembly includes a U-shaped plate member. The plate member encompasses a U-shaped chamber defined by inner sides of the plate member. The plate member includes a gusset or clasp member extending from an outer side of the plate member. The plate member further includes a pin extending from the outer side of the plate member. The gusset receives a rack of an exercise apparatus. The pin inserts in one of a plurality of rack openings and connects the bracket assembly to the rack. A user places a barbell in the plate member through the chamber. The U-shaped chamber allows the user to have a safe and controlled upward and downward motion for performing exercises with the barbell while in a seated or standing position. The U-shaped chamber acts as a holder for the barbell and prevents the user from tipping over or losing balance holding the barbell in the chamber.

In one advantageous feature of the present invention, the presently disclosed bracket assembly attaches to the rack via the pin and the gusset, while also creating a chamber that will maintain control of the barbell. This control prevents the user from tipping over or losing their balance while performing the intended exercise. This ensures the user to perform a specific exercise e.g., calf exercise in a safe manner with limited risk of injury.

In another advantageous feature of the present invention, the presently disclosed bracket assembly having a unique u-shaped chamber provides stability for a bar or barbell in a vertical lifting motion while performing exercises.

Features and advantages of the invention hereof will become more apparent in light of the following detailed description of selected embodiments, as illustrated in the accompanying FIGUREs. As will be realised, the invention disclosed is capable of modifications in various respects, all without departing from the scope of the invention. Accordingly, the drawings and the description are to be regarded as illustrative in nature.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE EMBODIMENTS

Before the present features and working principle of a bracket assembly for an exercise apparatus is described, it is to be understood that this invention is not limited to the particular system as described, since it may vary within the specification indicated. Various features of a bracket assembly for an exercise apparatus might be provided by introducing variations within the components/subcomponents disclosed herein. It is also to be understood that the terminology used in the description is for the purpose of describing the particular versions or embodiments only, and is not intended to limit the scope of the present invention, which will be limited only by the appended claims. The words "comprising," "having," "containing," and "including," and other forms thereof, are intended to be equivalent in meaning and be open-ended in that an item or items following any one of these words is not meant to be an exhaustive listing of such item or items, or meant to be limited to only the listed item or items.

It should be understood that the present invention describes a bracket assembly for an exercise apparatus. The bracket assembly includes a U-shaped plate member (i.e., a first plate, a second plate and an extension plate). The plate member encompasses a chamber defined by inner sides of the plate member. The plate member includes a gusset (an extending member and an encasing member) extending from an outer side of the plate member. The plate member further includes a pin extending from the outer side of the plate member. The gusset receives a rack of an exercise apparatus. The pin inserts in one of a plurality of rack openings and connects the bracket assembly to the rack. A user places a barbell in the plate member through the chamber. The U-shaped chamber allows the user to have a safe and controlled upward and downward motion for performing exercises with the barbell while in a seated or standing position. The U-shaped chamber acts as a holder for the barbell and prevents the user from tipping over or losing balance holding the barbell in the chamber.

Various features and embodiments of a bracket assembly for an exercise apparatus are explained in conjunction with the description of FIGS. 1-5.

Figure 1:
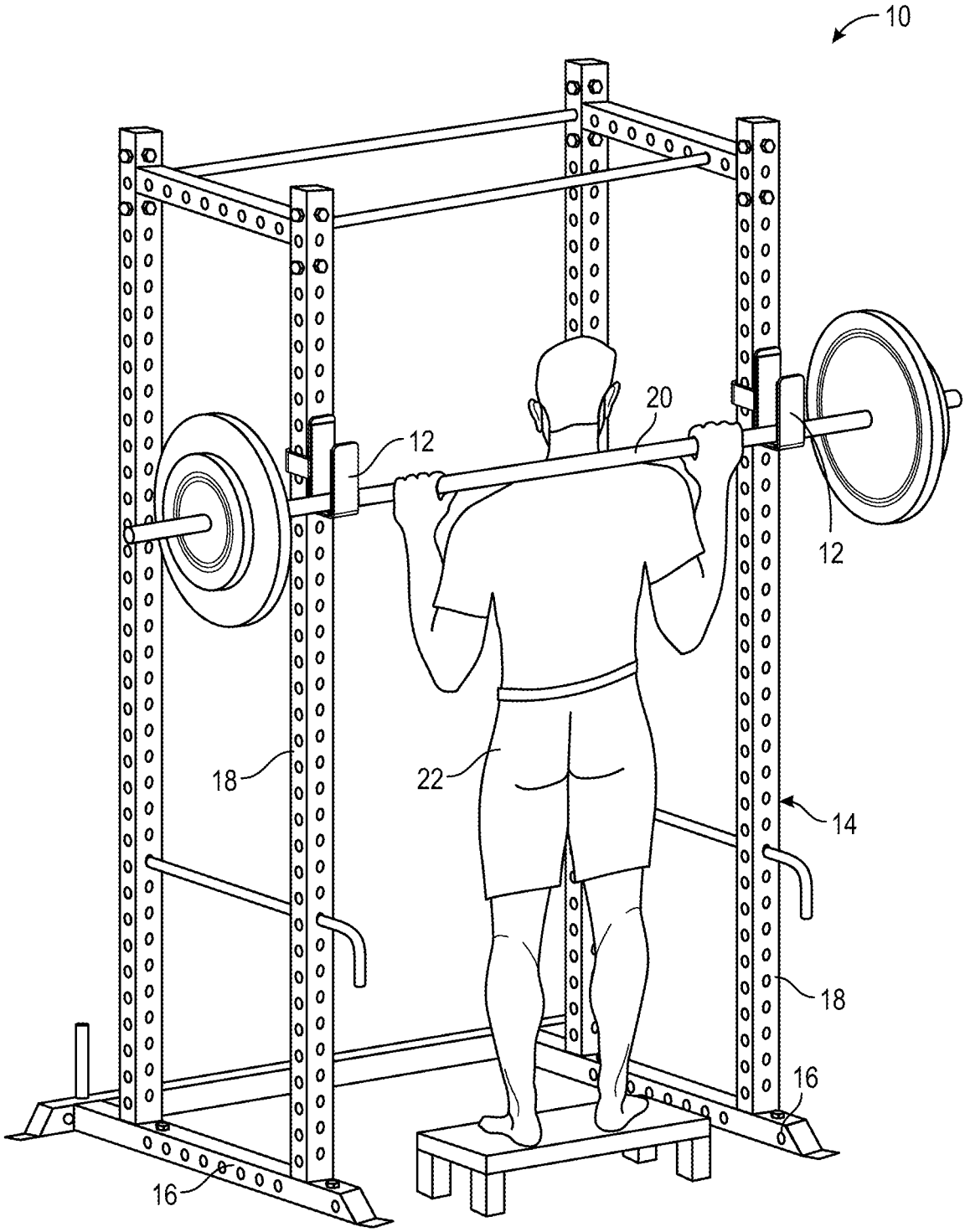
FIG. 1 illustrates an environment in which a bracket assembly connects to an exercise apparatus, in accordance with one embodiment of the present invention.

The present invention discloses a bracket assembly for an exercise apparatus and the like. FIG. 1 shows environment 10 in which bracket assembly 12 connects to an exercise apparatus 14, in accordance with one embodiment of the present invention. In one example, exercise apparatus 14 includes a rack or rig. In other example, exercise apparatus 14 includes, but not limited to, a squat rack, a standing calf machine, an overhead lat pull, a standing biceps bench, a supine bench, an incline/decline bench, a leg press machine, a seated biceps bench, a seated calf machine, a leg curl machine, a thigh extension machine, an abdominal board, a roman chair sit-up machine, a hack leg machine, a chinning bar, a dipping bar, a horizontal lat pull, a lat rowing bar, a weight stand, and a cable pull. The present invention is explained considering exercise apparatus 14 is a rig or rack being used for performing standing calf raises. However, a person skilled in the art understands that bracket assembly 12 can be configured to use with any of the above exercise apparatus 14 specified above without departing from the present invention.

Exercise apparatus 14 includes base members 16. Base members 16 releasably receive racks 18 in an upright position. Each rack 18 receives bracket assembly 12 that supports the weight of a bar or barbell 20 and the like. Barbell 20 enables user 22 to perform different exercises such as body building and physical fitness exercises.

Figure 2A:
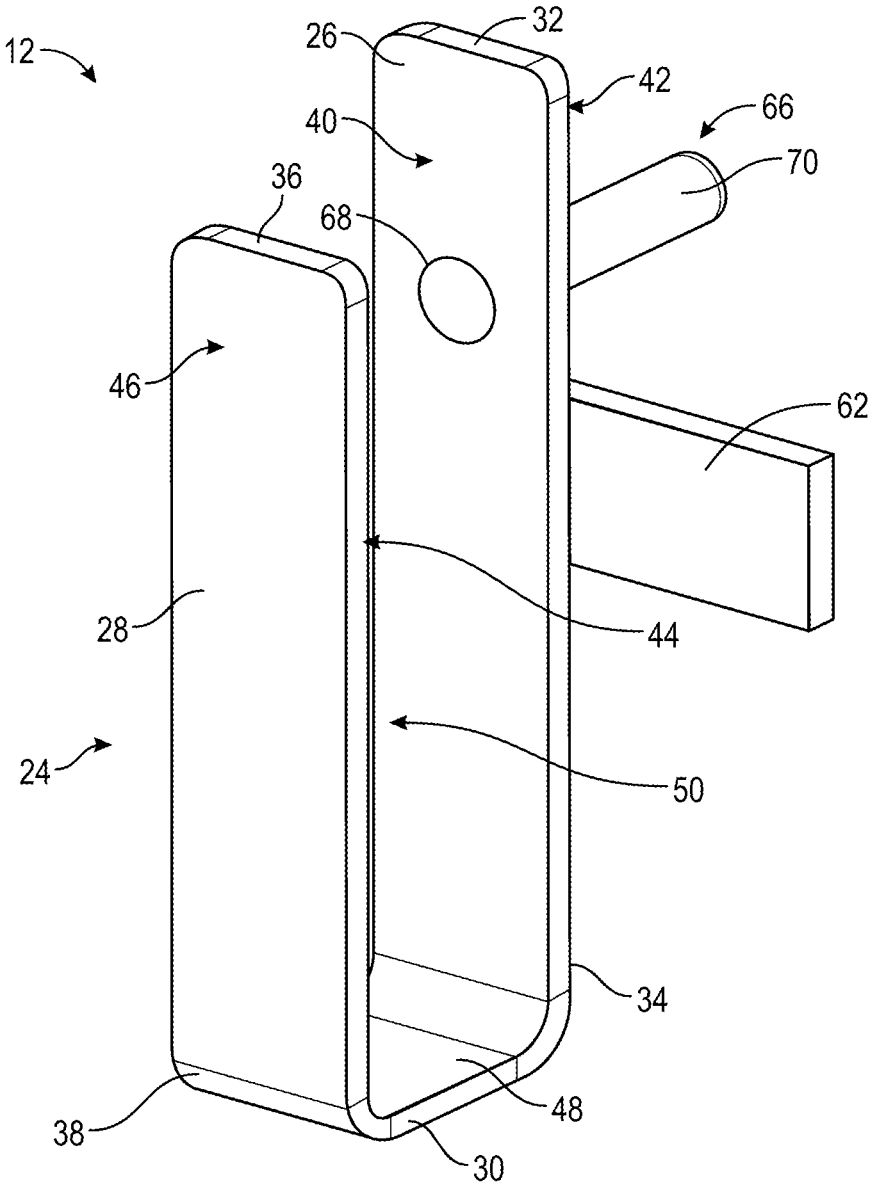
FIGS. 2A and 2B illustrate side perspective views of the bracket assembly.
Figure 2B:
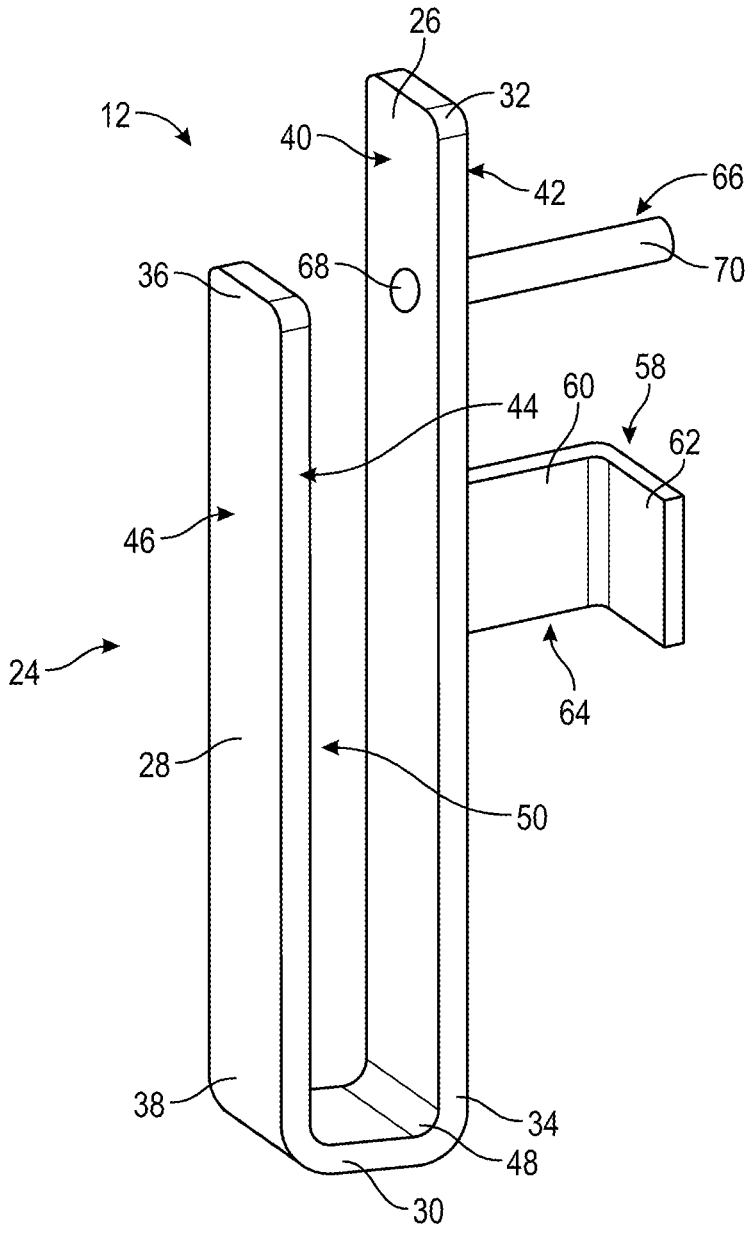

FIGS. 2A and 2B show perspective views of bracket assembly 12, in accordance with one embodiment of the present invention. Bracket assembly 12 includes plate member 24 having first plate 26 and second plate 28 connected by extension plate 30. Each of first plate 26, second plate 28 and extension plate 30 provides a material made of metal, hard plastic or any other suitable material having significant strength and longevity. Here, plate member 24 forms a U-shaped structure in which first plate 26 and second plate 28 position in parallel and extension plate 30 position in perpendicular and connect first plate 26 and second plate 28. As such, a person skilled in the art understands that first plate 26 and second plate 28 provide a pair of spaced plates connecting extension plate 30. In one example, first plate 26 and second plate 28 have the same length. In another example, first plate 26 is longer than second plate 28, or vice versa, depending on the need. A person skilled in the art understands that first plate 26, second plate 28 and extension plate 30 come as a single component. Alternatively, first plate 26, second plate 28 and extension plate 30 come as separate components secured or attached to one another using different means and structures, such as welding, adhesion, interference, fasteners, or combinations thereof.

First plate 26 includes top end 32 and bottom end 34. Similarly, second plate 28 includes top end 36 and bottom end 38. As can be seen, extension plate 30 connects to first plate 26 and second plate 28 at the bottom ends 34, 38.

Figure 4C:
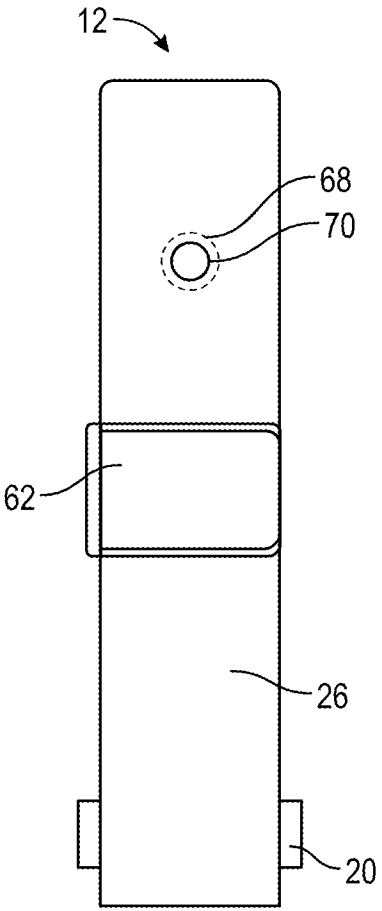
FIGS. 4A, 4B, 4C, 4D and 4E illustrate a side, a front, a rear, a bottom and a top view, respectively of the bracket assembly.
Figure 4B:
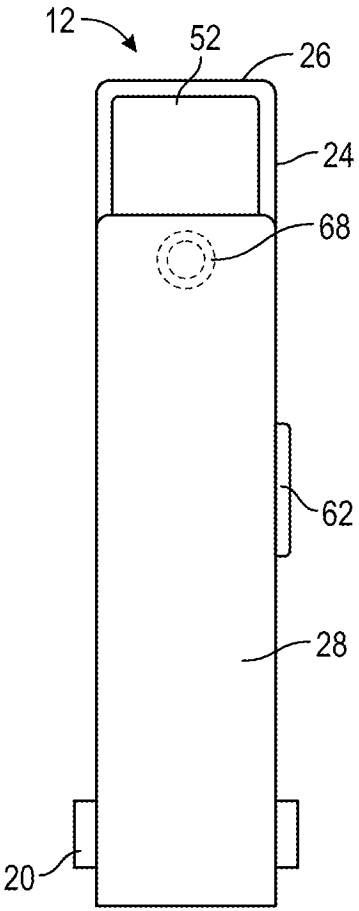
Figure 4A:
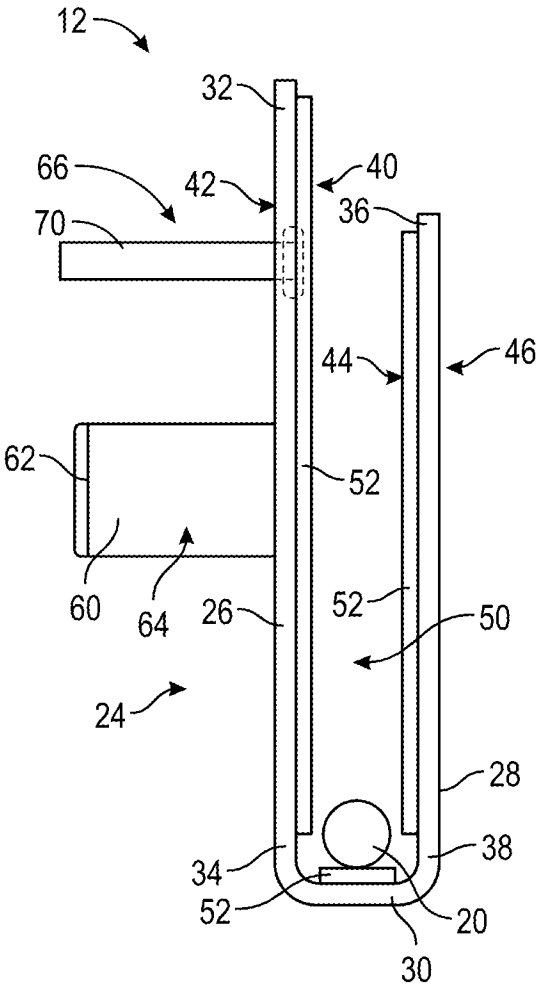
Figure 4D:
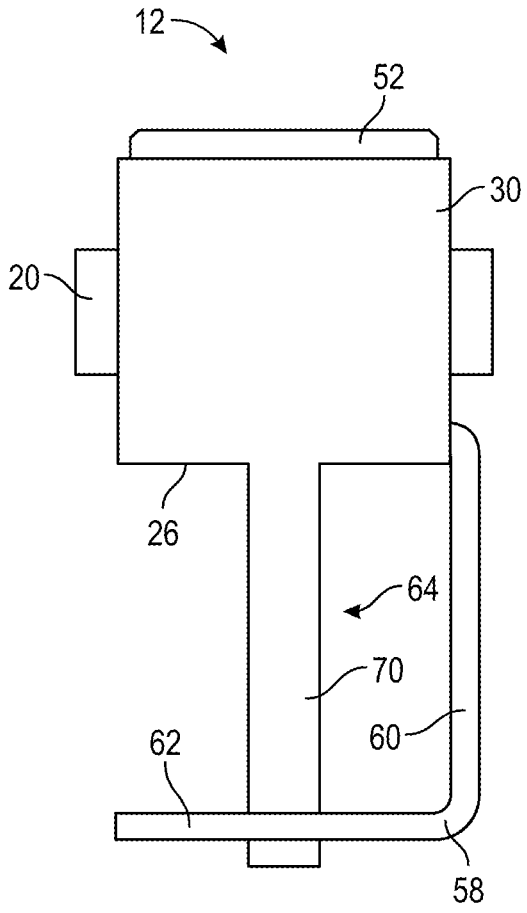
Figure 4E:
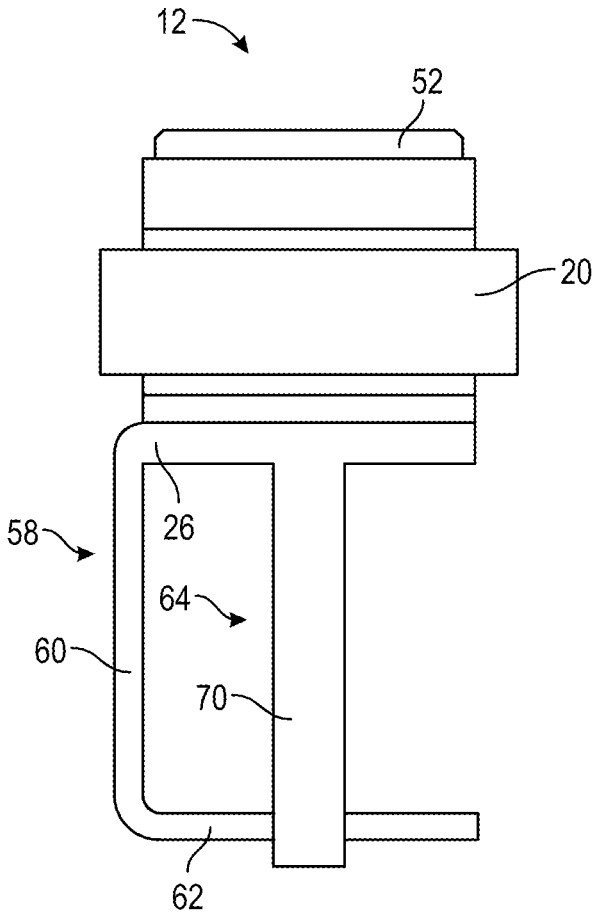

Further, first plate 26 includes inner side 40 and outer side 42. Similarly, second plate 28 includes inner side 44 and outer side 46. Furthermore, extension plate 30 includes inner side 48. Inner sides 40, 44 and 48 define U-shaped chamber 50. Here, U-shaped chamber 50 indicates a channel or an opening extending from top ends 32, 36 to bottom ends 34, 38 of first plate 26 and second plate 28 and adjoining extension plate 30 (inner sides 40, 44 and 48). U-shaped chamber 50 receives a variety of accessories enabling user 22 to perform different body building and physical fitness exercises. For example, U-shaped chamber 50 allows to hang, hold or retain other structures/accessories. In accordance with the present invention, U-shaped chamber 50 receives barbell 20 having weights that user 22 uses to perform exercises. In other words, barbell 20 travels through U-shaped chamber 50 and rests at the bottom of plate member 24 i.e., at inner side 48 of extension plate 30, as shown in FIG. 4A, for example. Here, extension plate 30 acts as a support surface configured to engage and support an object such as barbell 20 in U-shaped chamber 50.

Figure 3:
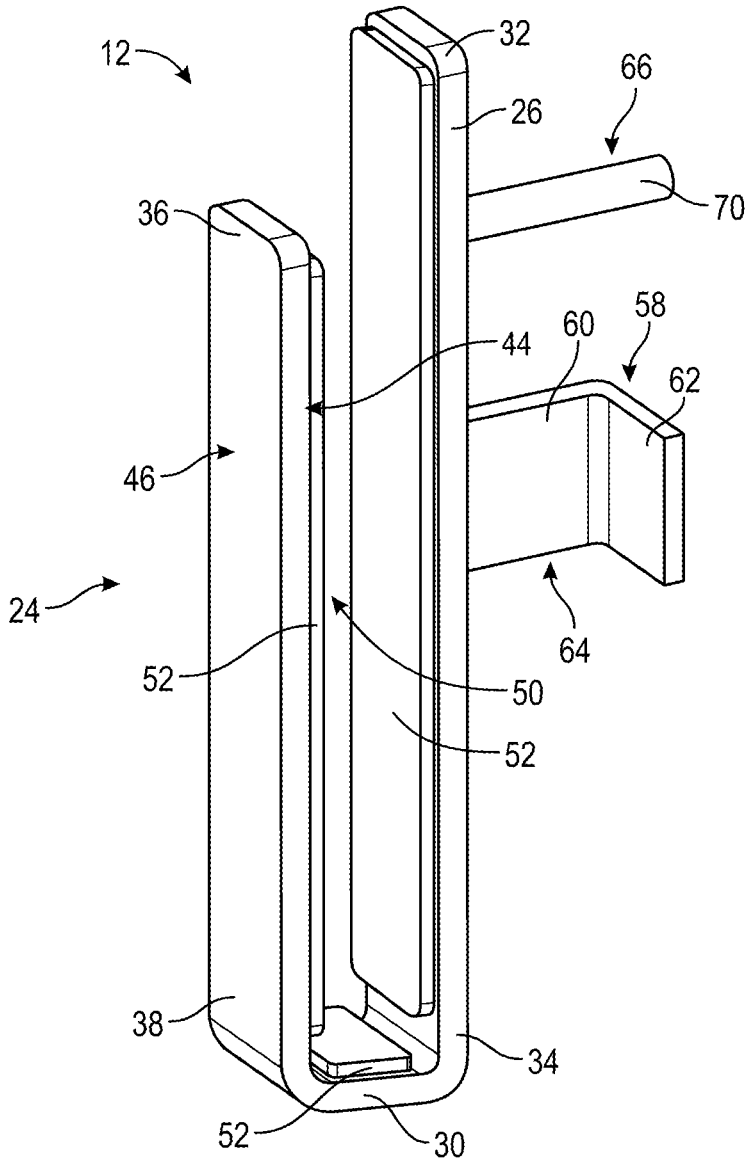
FIG. 3 illustrates a side perspective view of the bracket assembly having a protection plate, respectively of the bracket assembly.

In one implementation, each of first plate 26, second plate 28 and extension plate 30 encompasses protection plate 52. FIG. 3 shows a perspective view of first plate 26, second plate 28 and extension plate 30 encompassing protection plate 52. FIGS. 4A, 4B, 4C, 4D and 4E show a side, a front, a rear, a bottom and a top view of bracket assembly 12 having barbell 20. As can be seen from at least FIG. 4A, protection plate 52 runs the entire length or substantial length of inner sides 40, 44 and 48. Protection plate 52 provides a material made of a resilient or an elastic material such as plastic or acetyl resin material, or any other suitable material. Protection plate 52 acts as a layer between U-shaped chamber 50 and inner sides 40, 44 and 48. Optionally, protection plate 52 acts as a sleeve or spacer between first plate 26, second plate 28 and extension plate 30, and barbell 20. Protection plate 52 helps to reduce friction between first plate 26, second plate 28 and extension plate 30 and barbell 20 and increases the life of plate member 24 and/or barbell 20. In one implementation, protection plate 52 encompasses first screw holes (not shown). Further, first plate 26, second plate 28 and extension plate 30 encompass second screw holes (not shown). Here, protection plate 52 mounts over first plate 26, second plate 28 and extension plate 30 such that the first screw holes align with the second screw holes. Further, fasteners (not shown) insert through the first screw holes and the second screw holes to keep protection plate 52 in place over first plate 26, second plate 28 and extension plate 30. Alternatively, protection plate 52 mounts over first plate 26, second plate 28 and extension plate 30 using other known mechanisms such as adhesive, hook and loops, for example.

First plate 26 encompasses gusset or clasp member or bracket 58 extending from outer side 42 of first plate 26, as shown in at least FIGS. 2A, 2B, 3 and 4A. Gusset 58 provides a material made of metal, hard plastic or any other suitable material having significant strength and longevity. A person skilled in the art understands that gusset 58 and first plate 26 come as a single component. In other words, clasp member 58 is integrally formed (i.e., formed as a unitary, monolithic element of one-piece construction) with first plate 26. Alternatively, gusset 58 and first plate 26 come as separate components secured or attached to one another using different means and structures, such as welding, adhesion, interference, fasteners, or combinations thereof.

Gusset 58 includes extending member 60 extending perpendicularly from outer side 42 of first plate 26. Extending member 60 connects to encasing member 62 perpendicularly. As can be seen from FIGS. 2A, 2B, 3, 4D and 4E, encasing member 62 is perpendicular to extending member 60 and is substantially parallel with outer side 42 of first plate 26. Encasing member 62 extends slightly outward from first plate 26 (FIG. 4B). Outer side 42 of first plate 26, extending member 60 and encasing member 62 define rack receiving opening 64 (FIGS. 2A and 2B). A person skilled in the art understands that gusset 58 is sized to receive rack 18 of exercise apparatus 14 at rack receiving opening 64, as shown in FIG. 5.

In addition, first plate 26 encompasses pin 66, as shown in FIGS. 2A, 2B, 3, 4A, 4D and 4E. Pin 66 includes head 68 and shank 70. Head 68 encompasses an enlarged diameter than shank 70 and supports connection of shank 70 to first plate 26. In one example, head 68 is welded to either at inner side 40 or outer side 42 of first plate 26. In one example, head 68 is welded to either at inner side 40 or outer side 42 of first plate 26. Alternatively, pin 66 releasably connects to first plate 26. Here, shank 70 draws through a hole (not shown) at first plate 26 from inner side 40 and extends from outer side 42 of first plate 26. In one example, shank 70 extends beyond encasing member 62, as shown in at least FIGS. 4D and 4E.

Figure 5:
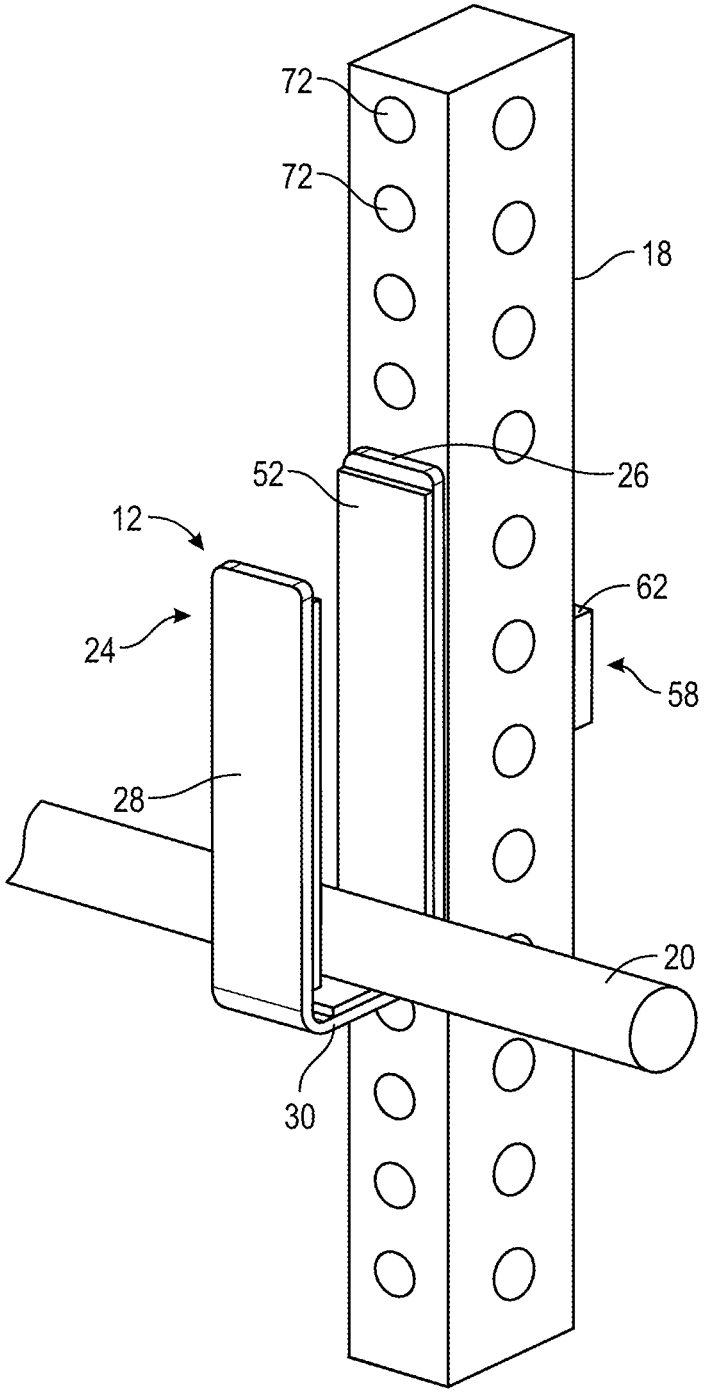
FIG. 5 illustrates the bracket assembly connected to a rack of the exercise apparatus, in accordance with one exemplary embodiment of the invention.

FIG. 5 shows a feature of bracket assembly 12 connecting rack 18 and receiving barbell 20 at extension plate 30. In one implementation, rack 18 encompasses a plurality of rack openings 72 extending over its entire length (FIG. 1). In accordance with one embodiment of the present embodiment, gusset 58 receives rack 18. Specifically, gusset 58 receives rack 18 at rack receiving opening 64 i.e., between outer side 42 of first plate 26, extending member 60 and encasing member 62. Subsequently, pin 66 i.e., shank 70 inserts in one of a plurality of rack openings 72 of rack 18. Shank 70 inserts/rotates down until gusset 58 secured in place in one of plurality of rack openings 72 of rack 18. A person skilled in the art understands that user 22 positions pin 66 in a different rack opening 72 to position bracket assembly 12 at a desired height along rack 18 (or at desired height from ground or base members 18), as shown in FIG. 1. Although FIG. 1 and/or FIG. 5 show bracket assembly 12 connecting along rack 18 in a vertical configuration, it is obvious to a person skilled in the art to position bracket assembly 12 at a different rack opening 72 to position bracket assembly 12 at a desired length along rack 18 without departing from the scope of the present invention.

User 22 attaches bracket assembly 12 at one or both racks 18 and places barbell 20 in U-shaped chamber 50 and lowers into resting position at the bottom of extension plate 30. After connecting bracket assembly 12 at a desired height on rack 18, user 22 adds weights to barbell 20. Subsequently, user 22 performs different weightlifting exercises using barbell 20 having weights as shown in FIG. 1, for example. In order to perform a weightlifting exercise, e.g., calf muscle exercise or standing calf raises, user 22 removes barbell 20 from bracket assembly 12 and places it on his shoulders. Here, user 22 positions himself under barbell 20 and pushes upward against barbell 20 using his calves. This upward motion lifts barbell 20 through U-shaped chamber 50 in a vertical alignment. Even if user 22 loses his balance slightly while lifting, the longer U-shaped chamber 50 formed due to the U-shaped structure of plate member 24 ensures barbell 20 movement is in vertical alignment and avoids slippage from plate member 24. This allows user 22 to focus on a rhythmic motion and less about maintaining balance of barbell 20 with weights.

After performing weightlifting exercise, user 22 places barbell 20 at inner side 48 of extension plate 30 through U-shaped chamber 50. As specified above, first plate 26 and second plate 28 have substantially the same length (or first plate 26 is longer than second plate 28). As such, barbell 20 firmly sits at inner side 48 of extension plate 30 in a vertical motion and avoids accidental slippage of barbell 20 from plate member 24. In other words, U-shaped chamber 50 of inner sides 40, 44 and 48 acts as a holder at the bottom i.e., at extension plate 30 and facilitates upward and downward motion of barbell 22. This ensures safety of user 22 and prevents user 22 from tipping over or losing balance holding barbell 20 in U-shaped chamber 50. As a result, user 22 can focus on exercise movement and less about balance.

Although the above description is explained considering that the bracket assembly connects to the exercise apparatus directly, a person skilled in the art understands that the bracket assembly can come either as a single unit, or assembled parts to achieve the improved bracket assembly having a U-shaped plate for holding a barbell and the like firmly to an exercise apparatus and prevents the barbell from slipping and injuring the user without deviating from the scope of the present invention. That is, in the event that a portion presently disclosed invention were to be conjoined with a prior device, and through such conjoining reach the invention of the present disclosure, then such conjoined invention is to be considered within the scope of the presently disclosed invention, and protectable as such. Moreover, regardless of how the presently disclosed U-shaped chamber may be formed, such a device is within the scope of the present invention.

Based on the above, it is evident that the presently disclosed bracket assembly provides a U-shaped chamber that allows a safe and controlled motion for performing exercises with a barbell while in a seated or standing position. The bracket assembly keeps the user safe by preventing them from tipping over or losing balance containing the barbell in a chamber, allowing them to focus on the exercise movement, and less about balance.

The presently disclosed bracket assembly provides a barbell guidance chamber that attaches to racks or posts. The U-shaped chamber keeps the upward and downward movement of the barbell in a vertical alignment and allows the user to have a rhythmic motion while performing a weight-lifting exercise. In one example, the bracket assembly comes as a standalone unit for facilitating training calves with a barbell.

A person skilled in the art appreciates that the bracket assembly may come in a variety of shapes and sizes depending on the need and comfort of the user. Further, different materials in addition to or instead of materials described herein may also be used and such implementations may be construed to be within the scope of the present invention. Further, many changes in the design and placement of components may take place without deviating from the scope of the presently disclosed bracket assembly.

In the above description, numerous specific details are set forth such as examples of some embodiments, specific components, devices, methods, in order to provide a thorough understanding of embodiments of the present invention. It will be apparent to a person of ordinary skill in the art that these specific details need not be employed, and should not be construed to limit the scope of the invention.

In the development of any actual implementation, numerous implementation-specific decisions must be made to achieve the developer's specific goals, such as compliance with system-related and business-related constraints. Such a development effort might be complex and time-consuming, but may nevertheless be a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

The foregoing description of embodiments is provided to enable any person skilled in the art to make and use the invention. Various modifications to these embodiments will be readily apparent to those skilled in the art, and the novel principles and invention disclosed herein may be applied to other embodiments without the use of the innovative faculty. It is contemplated that additional embodiments are within the spirit and true scope of the disclosed invention.

What is claimed is:

1. A bracket assembly, comprising:

a first plate;

a second plate positioned in parallel to said first plate;

an extension plate connecting said first plate and said second plate, wherein said extension plate connects perpendicular to said first plate and said second plate, wherein said first plate, said second plate and said extension plate form a U-shaped structure, wherein each of first plate, said second plate and said extension plate comprises an inner side and an outer side, and wherein said inner sides of said first plate, said second plate and said extension plate define a U-shaped chamber;

an extending member extending from said outer side of said first plate;

an encasing member extending perpendicularly from said extending member, and positioning parallel and facing said outer side of said first plate, and wherein said extending member, said encasing member, and said outer side of said first plate define a rack receiving opening wherein a plane extending perpendicular to the inner side of the second plate and vertically above the encasing member intersects at least a portion of the second plate and the first plate; and a pin having a shank, wherein said shank extends from said outer side of said first plate, wherein said rack receiving opening receives a rack, wherein said shank inserts into an aperture of a plurality of rack openings formed in said rack, and wherein said U-shaped chamber receives and secures a barbell in a vertical lifting motion.

2. The bracket assembly of claim 1, wherein said first plate is longer than said second plate.

3. The bracket assembly of claim 1, wherein said first plate and said second plate have same length.

4. The bracket assembly of claim 1, wherein each of said first plate, said second plate and said extension plate comprises a protection plate at respective inner side.

5. The bracket assembly of claim 4, wherein said protection plate acts as a sleeve or spacer between said first plate, said second plate and said extension plate, and said U-shaped chamber.

6. The bracket assembly of claim 4, wherein said protection plate reduces friction between said first plate, said second plate and said extension plate and said barbell.

7. The bracket assembly of claim 4, wherein said protection plate mounts to said first plate, said second plate and said extension plate using an adhesive.

8. The bracket assembly of claim 4, wherein said protection plate comprises first screw holes, wherein each of said first plate, said second plate and said extension plate comprises second screw holes, and wherein said first screw holes align with said second screw holes and receive fasteners to connect said protection plate over said first plate, said second plate and said extension plate.

9. The bracket assembly of claim 4, wherein said protection plate mounts over said first plate, said second plate and said extension plate using hook and loops.

10. The bracket assembly of claim 1, wherein said pin comprises a head, and wherein said head is welded to said first plate.

11. The bracket assembly of claim 10, wherein said first plate comprises a hole therethrough from said inner side to said outer side, and wherein said shank connects at said inner side of said first plate and said shank draws through said hole and extends from said outer side of said first plate.

12. The bracket assembly of claim 1, wherein said pin positions above said extending member and said encasing member.

13. A bracket assembly for supporting a barbell on an exercise device having racks spaced apart, each rack having a plurality of rack openings, said bracket assembly comprising:

a first plate;

a second plate positioned in parallel to said first plate;

an extension plate connecting said first plate and said second plate, wherein said extension plate connects perpendicular to said first plate and said second plate, wherein said first plate, said second plate and said extension plate form a U-shaped structure, wherein each of first plate, said second plate and said extension plate comprises an inner side and an outer side, wherein said inner sides of said first plate, said second plate and said extension plate define a U-shaped chamber;

an extending member extending from said outer side of said first plate;

an encasing member extending perpendicularly from said extending member and positioning parallel and facing said outer side of said first plate, and wherein said extending member, said encasing member, and said outer side of said first plate define a rack receiving opening wherein a plane extending perpendicular to the inner side of the second plate and vertically above the encasing member intersects at least a portion of the second plate and the first plate; and a pin having a shank, wherein said shank extends from said outer side of said first plate, wherein the rack receiving opening receives a rack of the racks, wherein said shank inserts into an aperture of a plurality of rack openings formed in said rack, and wherein said U-shaped chamber receives and secures the barbell in a vertical lifting motion.

14. The bracket assembly of claim 13, wherein each of said first plate, said second plate and said extension plate comprises a protection plate at respective inner side.

15. The bracket assembly of claim 14, wherein said protection plate acts as a sleeve or spacer between said first plate, said second plate and said extension plate, and said U-shaped chamber.

16. The bracket assembly of claim 14, wherein said protection plate mounts over said first plate, said second plate and said extension plate using one of an adhesive, hook and loops and fasteners.

17. The bracket assembly of claim 13, wherein said pin positions above said extending member and said encasing member.

18. A method of providing a bracket assembly for an exercise apparatus, comprising:

providing a first plate;

providing a second plate parallel to said first plate;

providing an extension plate connecting said first plate and said second plate, said extension plate connecting perpendicular to said first plate and said second plate, said first plate, said second plate and said extension plate forming a U-shaped structure, each of first plate, said second plate and extension plate comprising an inner side and an outer side, said inner sides of said first plate, said second plate and said extension plate defining a U-shaped chamber;

providing an extending member extending from said outer side of said first plate;

providing an encasing member extending perpendicularly from said extending member, and positioning parallel and facing said outer side of said first plate, said extending member, said encasing member, and said outer side of said first plate defining a rack receiving opening wherein a plane extending perpendicular to the inner side of the second plate and vertically above the encasing member intersects at least a portion of the second plate and the first plate;

providing a pin having a shank, said shank extending from said outer side of said first plate;

receiving a rack of said exercise apparatus in said rack receiving opening;

inserting said shank into an aperture of a plurality of rack openings formed in said rack;

receiving and securing a barbell in said U-shaped chamber.

19. The method of claim 18, further comprising providing said first plate longer than said second plate.

20. The method of claim 18, further comprising providing a protection plate at inner sides of each of said first plate, said second plate and said extension plate.

* * * * *